United States Patent [19]

Boshold

[11] 4,244,205

[45] Jan. 13, 1981

[54] APPARATUS FOR ALIGNING EXTRUSION PRODUCING MEMBERS OF A PRESS

[75] Inventor: Raymond F. Boshold, Springfield, Pa.

[73] Assignee: Wean United Inc., Pittsburgh, Pa.

[21] Appl. No.: 899,953

[22] Filed: Apr. 25, 1978

[51] Int. Cl.[3] ..... B21C 27/00; B21C 23/00

[52] U.S. Cl. ..... 72/263; 72/264; 72/272

[58] Field of Search ..... 72/263, 264, 253, 272

[56] References Cited

U.S. PATENT DOCUMENTS

| | | | |
|---|---|---|---|
| 572,872 | 12/1896 | Dick | 72/263 |
| 2,830,701 | 4/1958 | Kent | 72/272 |
| 3,186,208 | 6/1965 | Samuel | 72/263 |
| 3,221,531 | 12/1965 | Salter | 72/263 |
| 3,611,778 | 10/1971 | Hubert | 72/272 |
| 3,798,953 | 3/1974 | Sgambati | 72/263 |

FOREIGN PATENT DOCUMENTS

| | | | |
|---|---|---|---|
| 2036199 | 12/1970 | France | 72/253 |
| 464354 | 6/1975 | U.S.S.R. | 72/253 |

*Primary Examiner*—Lowell A. Larson

*Attorney, Agent, or Firm*—Daniel Patch; Suzanne Kikel

[57] ABSTRACT

An arrangement for obtaining proper alignment of parts and proper sealing of parts in an extrusion press having an offset supporting shaft rotatably carrying a container holder assembly and two or more containers into which heated billets are placed to be brought to the extrusion station. A set of aligning keys diametrically opposite each other on both ends of each container engage with a corresponding set of keyways in a sealing member and a die slide respectively. Clearances provided between the containers and the container holder and between other keys and keyways used to mount the containers in the container holder allowing the containers to be moved in a direction to enable the sets of aligning keys to engage the keyways in the die slide and the sealing member to align the containers when in the extrusion station to other components of the press and to maintain these three elements in the aligned position with respect to the slide and sealing member, and in addition, the sealing member is guided on the same guideways as the main crosshead carrying the extrusion stem and mandrel.

10 Claims, 9 Drawing Figures

APPARATUS FOR ALIGNING EXTRUSION PRODUCING MEMBERS OF A PRESS

In present day multiple container extrusion presses a container holder by means of arms or the like are caused to carry two or more containers which in turn carry heated billets, the holder being offset from the extrusion station of the press and adapted to rotate to successfully bring the containers into the station. The heated billets and the continuous operation of the press over a normal period causes significant thermal expansion of the container holder in the press. In view of the offset arrangement of the container holders a problem arises on its thermal expansion in maintaining the centerline of the containers coincident to the working centerline of the press, since the arms of the container holder upon expansion throw the containers off-center with respect to the press working axis.

When the extrusion press is initially operated at the beginning of the working period, the container holder and particularly its arms are relatively cold and therefore there is no expansion error caused thereby to be of concern. However, as the operation of the press progresses and the container holder arms absorb considerable heat it produces a significant expansion error. Moreover, since the amount of expansion varies with the changing operating temperatures the problem of the expansion error has been made considerably more difficult to solve.

The necessity to compensate for such expansion error and to align the container with the working centerline of the press becomes imperative when extruding tubing which demands that the mandrel be concentric with the opening of the die. If an off-centered condition of the container exists, with respect to the die, the mandrel is also thrown off center by its engagement with the dummy block in the container thereby resulting in extruding an eccentric tubing. In addition, a proper sealing between the die and the container cannot be established in such conditions since their respective cooperating faces are not coincident, causing cocking of the container, aggravating an already undesirable non-concentricity condition and causing heavy die and container wear around the sealing area.

It is an object of the present invention to provide a method and apparatus to overcome the above disadvantages by compensating for the varying operating temperatures of the container holder by allowing a proportionate compensating movement of the containers to align the containers on the working centerline of the press and to maintain the containers in this position, particularly prior to the mandrel entering the dummy block in presses having such elements.

It is another object of the present invention to provide in an extrusion press including a container-container holder assembly having a container holder with an opening for supporting a container into which a heated billet is placed, and a die slide supporting a die assembly on the working centerline of the press, said container-container holder assembly being positionable into and out of a working position relative to said working centerline of the press and when in said working position adapted to position said container adjacent to said die slide so that the container axis is coaxial with the die assembly, said container-container holder assembly and said die slide including mutual cooperating means for allowing movement of said container relative to said holder in a direction toward said working centerline to obtain a predetermined registration of said container with said die slide and for maintaining said container in said predetermined position.

Another object of the present invention is to provide in an extrusion press including a container-container holder assembly having a container holder with an opening for supporting a container into which a heated billet is placed, and a sealing member on the working centerline of the press, said container-container holder assembly being positionable into and out of a working position relative to said working centerline of the press and when in said working position adapted to position said container adjacent to said sealing member so that the axis of said container is coaxial with the sealing member, said container-container holder assembly and said sealing member including mutual cooperating means for allowing movement of said container relative to said holder in a direction toward said working centerline to obtain a predetermined registration of said container with said sealing member and for maintaining said container in said predetermined position.

A still further object of the present invention is to provide in a method of operating an extrusion press including a container-container holder assembly having a container holder with an opening for supporting a container into which a heated billet is placed, a die slide supporting a die assembly on the working centerline of the press, said container-container holder assembly positionable into and out of a working position relative to said working centerline of the press, and when in said working position said container being positionable adjacent to said die slide so that the axis of said container is coaxial with said die assembly, the steps including: allowing movement of said container when in said working position relative to said holder in a direction toward said working centerline to obtain a predetermined and registration of said container with said die slide, effecting said movement and registration bycausing said container to move into the direction toward said working centerline into an operative position with said die slide, tha thereafter maintaining said container in said predetermined position.

These objects and other novel features and advantages of the present invention will be better appreciated when the following description of one embodiment thereof is read along with the accompanying drawings of which:

Figure 4B:
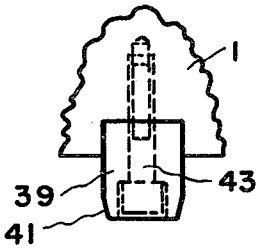
Figure 4A:
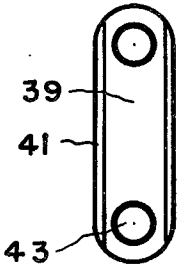
Figure 3:
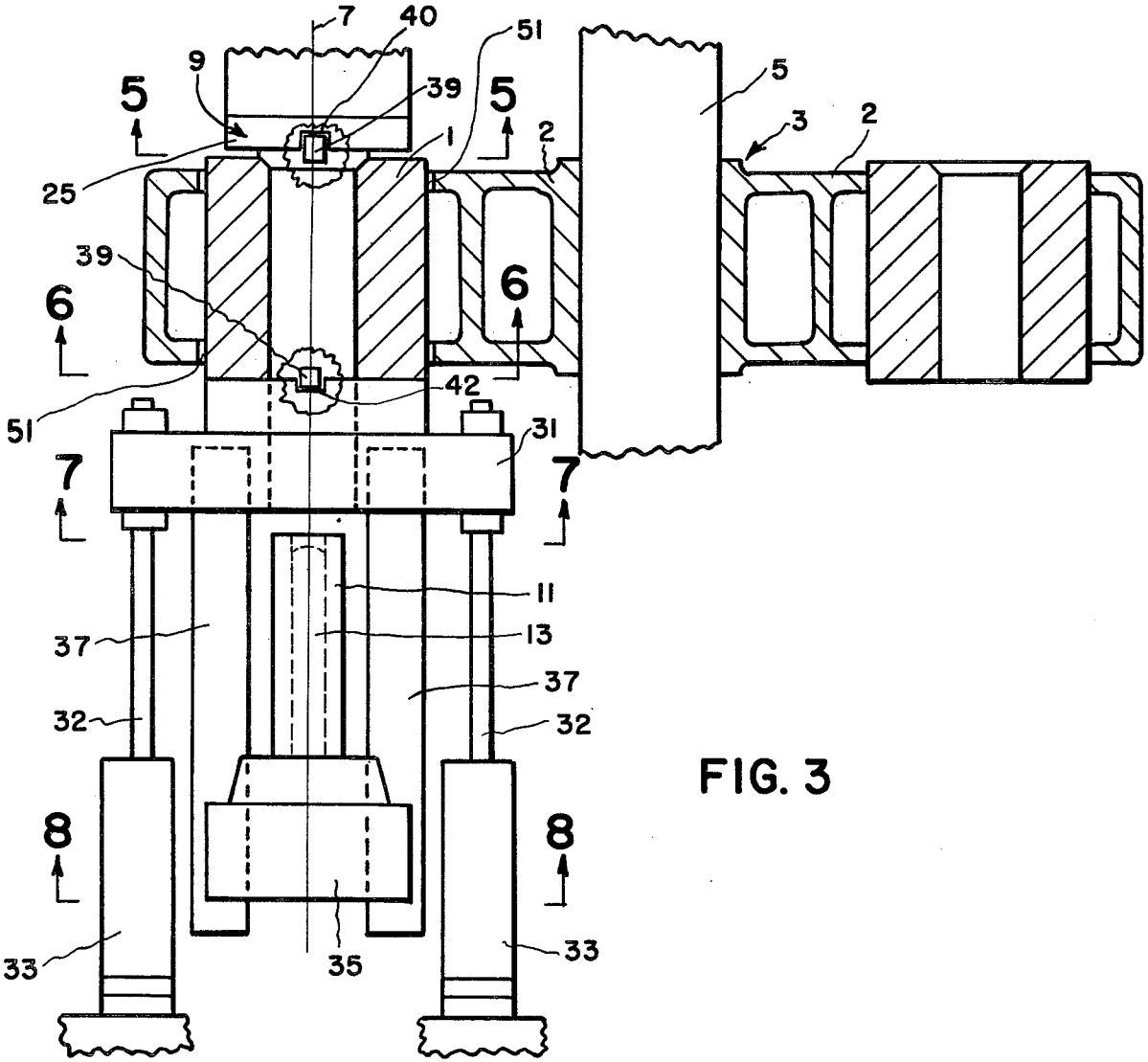
FIG. 3 is an elevational view partly in section, taken along lines 3—3 of FIG. 6 and having some portions broken away for clarity to illustrate the relationship of the key and keyway which are in exaggerated form on the die slide side of the container.
Figure 5:
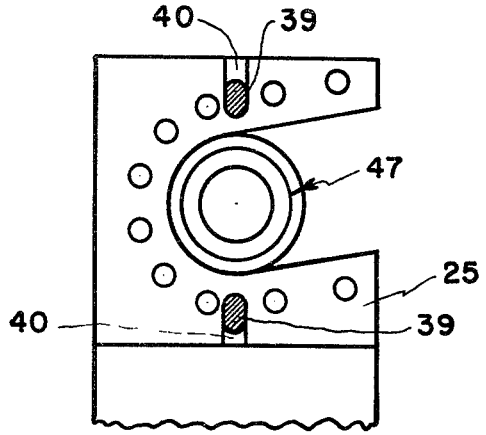
Figure 6:
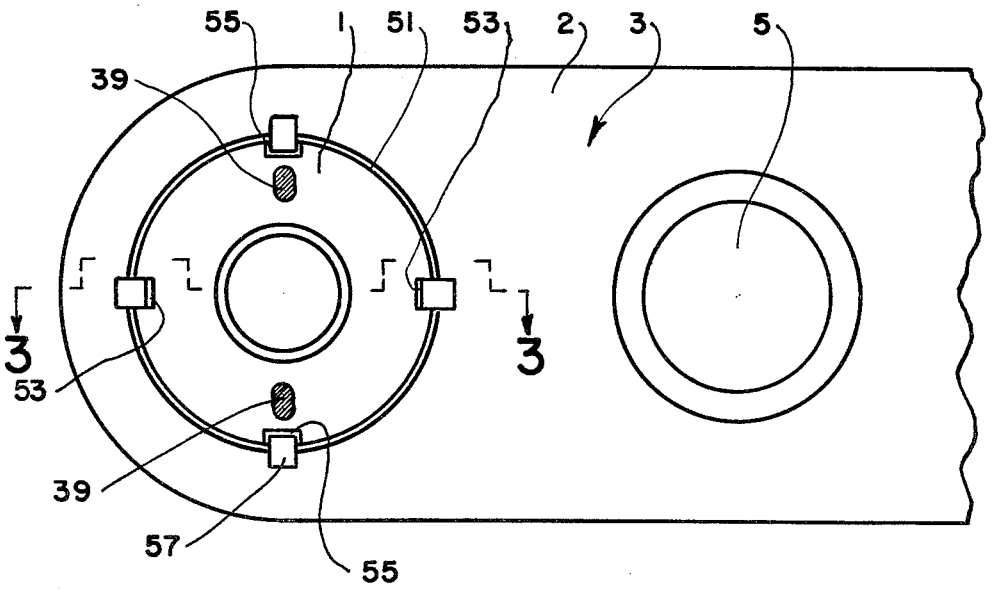
Figure 8:
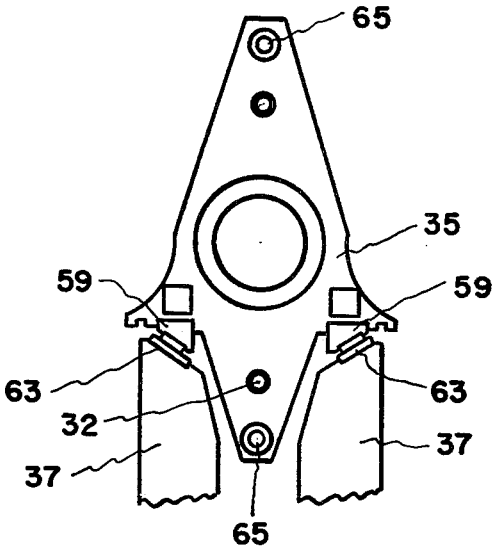
Figure 7:
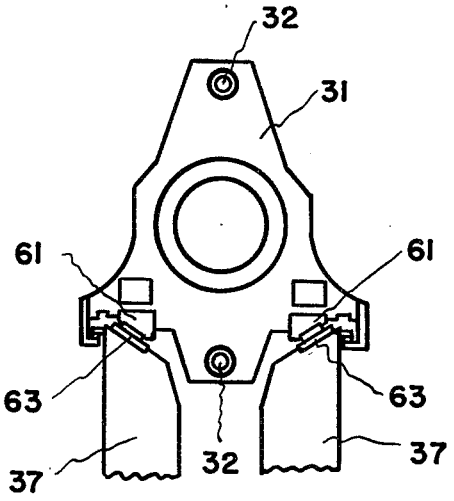

FIG. 4*a* illustrates an enlarged plan view of the container-sealing crosshead key appearing in FIG. 3, and FIG. 4*b* is a front view thereof;

FIGS. 5 and 6 are sectional views taken along lines 5—5 and 6—6, respectively of FIG. 3, and FIGS. 7 and 8 are sectional views taken along lines 7—7 and lines 8—8 of FIG. 3 in which the piston cylinder assemblies of the sealing member are rotated for clarity.

Figure 1:
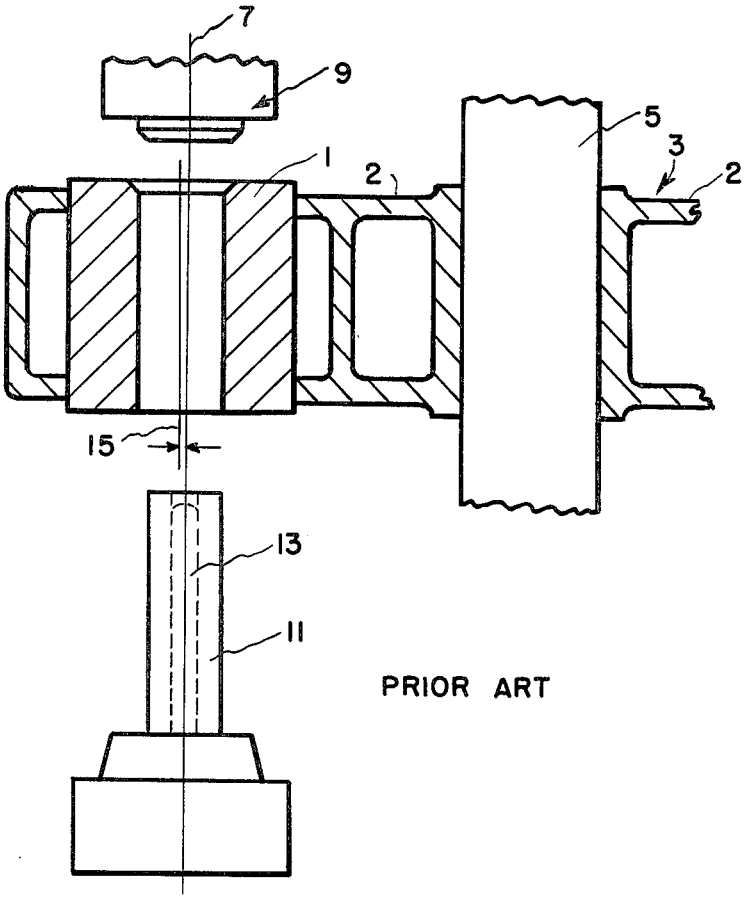
FIGS. 1 and 2 represent in simplified form the expansion error condition prior to and after extrusion as practiced by the prior art.
Figure 2:
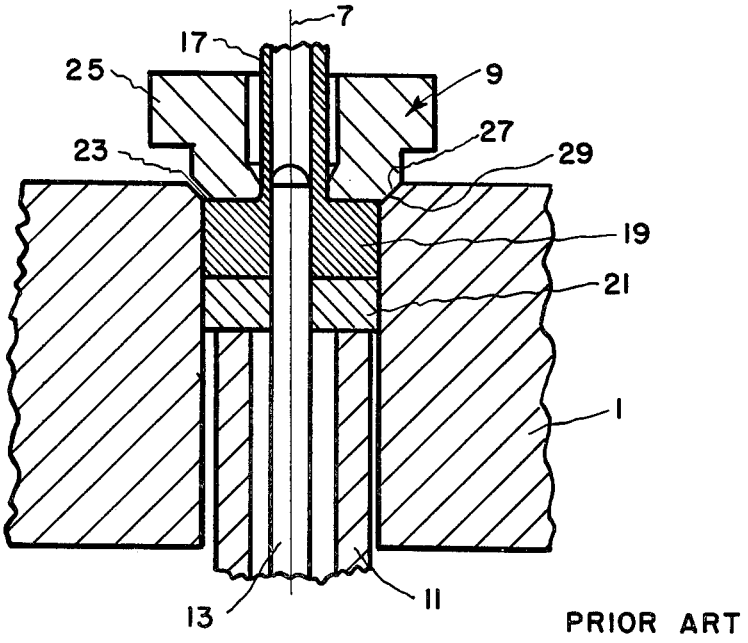

FIGS. 1 and 2, as noted, serve to illustrate some of the stated disadvantages of the prior art. It will be appreciated that the elements and working relationship generally shown in these drawings and in the remaining drawings are generally well known in the extrusion press industry so that a detailed description thereof will not be given.

In FIG. 1 a multiple container extrusion press similar to that disclosed in U.S. Pat. No. 3 867 828 is shown consisting of a container 1 carried in an arm 2 of a container holder 3 rotatably mounted around a fixed shaft 5. At one end of the container when positioned in the working centerline 7 of the press is a die-die slide assembly 9. On the other end there is arranged an extrusion stem 11 through which a mandrel 13 extends. An off-center condition, is exaggerated form, of the centerline 15 of the container relative to the working centerline 7 of the press, and hence of the centerline of the die, results in an error due to a radial thermal expansion of the arms 2 of the container holder and this error is represented by the distance between the two arrows shown.

FIG. 2 more fully illustrates an eccentric tube being produced from a billet 19 as a result of this radial expansion error shown in FIG. 1. A dummy block 21, according to usual practice, is placed into the container prior to its being brought into an extrusion station of the press so that the mandrel is guided into the dummy block along the off-center position of the container, thereby producing this eccentric tubing. Number 23 to the left of this FIG. 2 designates in exaggerated form a gap between the tapered surfaces of a die in a die slide 25 and a mating tapered surface of the container 1, which gap creates an inadequate sealing of the die holder against the adjacent container face. To the right of this FIG. 2 it can be seen that the tapered engaging surfaces 27 and 29 of the die and the container are forced against each other causing the stated prior art disadvantages. This tends to throw the container into a skewed relationship with the die causing additional misalignment.

Referring now to the present invention as shown in the remaining drawings where appropriate similar reference numbers will be employed, FIG. 3 illustrates a container holder assembly 3 having two or more arms 2, each carrying a container 1 rotatably mounted on the shaft 5. Container 1 is aligned by a rotation of the arms 2 on the working centerline 7 with a die slide 25, and more particularly its die and a sealing crosshead member 31 directly adjacent to the container in preparation for the extrusion operation. The sealing member 31 is advanced and retracted toward and away from the container by rods 32 of piston cylinder assemblies 33 over guideways 37. The main crosshead 35 carrying an extrusion stem 11 and a mandrel 13 is also mounted on the guideways 37. This arrangement of the guideways for the sealing member 31 and the main crosshead 35 assure that they will be advanced toward the container on the same working centerline as the press.

Still referring to FIG. 3 two sets of diametrically aligning keys 39 of container 1 engage with cooperative keyways 40 in the die slide 25 and keyway 42 in the sealing member 31 to maintain the container, die slide and sealing member in alignment. The construction of aligning keys 39, having chamfered surfaces 41, and the manner in which these keys are mounted by screws 43 into the container 1 are shown in FIGS. 4*a* and 4*b*. In FIG. 5 the one set of aligning keys 39 for the die slide, shown in section, are located in a diametrically opposite manner and are received in a corresponding set of keyways 40 in the die slide 25 supporting the die assembly 47. Referring to FIG. 6 a clearance 51 shown also in FIG. 3 between the container and the container holder and clearances 53 and 55 associated with four keys 57 which are used conventionally for mounting the container in the container holder allow the container to be moved only in lateral or horizontal opposite directions to allow a positioning of the container on the working centerline of the press. No movement is allowed in the vertical direction as one views FIG. 6. These clearances are equated to the maximum amount of radial thermal expansion of the arm 2 of container holder 3. In FIG. 6 as to the second set of aligned keys 39 diametrically opposite each other in the container 1, as mentioned, they engage keyways 42 in the sealing crosshead member 31. It is to be appreciated that even though the keys 39 may not be exactly aligned with their cooperative keyways 40–42 due to the radial thermal expansion, that the construction of the keys is such that wherever the keys 39 are located relative to the keyways 40–42, the chamfered edges 41 of the keys cause the keys to always engage the keyways and once engaged there can be no relative lateral or transverse movement. In other words, the amount of clearances provided, the thickness of the keys, and the extent of taper thereof are all equated with the maximum expected thermal expansion of the arm of the container. In this way, even if the container is positioned in an extreme horizontal position as one views FIG. 6, so that the clearance is all on one side of the adjacent key 39, on movement of the container toward the die slide or the sealing member toward the container, the keys 39 will find their keyways. It will be appreciated that the normal sequence is for the container aligning keys to first enter the die slide, and thereafter, for the sealing member keyways to pass over the other alignment keys of the container.

In FIGS. 7 and 8 the sealing member 31 and the main crosshead 35 each have two slides 59–61 for engaging a common rail 63 mounted on guideways 37. Whereas rods 32 of piston cylinder assemblies 33 motivate sealing member 31, piston rods 65 of piston cylinder assemblies which are not shown, advance main crosshead member 35.

In operation of the press, after the container is positioned by moving the container holder to the position shown in FIG. 3 the sealing member 31 is advanced, forcing the container against the die slide 25. During the initial positioning of the container 1 and sealing member 31 the aligning keys 39 and their location relative to keyways 40 and 42 and the fact that clearances 51, 53 and 55 permit movement of the container result in the keys 39 of the container entering keyways 40 of the die slide and keyways 42 of sealing member 31 to align and maintain the container and slide along the working press centerline. Once the sealing of the billet in the container has been effected main crosshead 35 is advanced toward the container. With all these critical components of the press in alignment relative to one another, the mandrel enters the dummy block in an on-center position producing a concentric tubing during which a proper sealing of the container with the die is maintained.

As mentioned, even though the disclosure illustrates only two containers, the present invention can be applied to other forms where the container is mounted in an offset manner. Only keys in the ends of the container with keyways in the die slide and sealing member are discussed. It is to be appreciated, however, that this invention operates just as well with keys in the die slide and sealing member and keyways in the ends of the container.

In accordance with the provisions of the patent statutes, I have explained the principle and operation of my invention and have illustrated and described what I consider to represent the best embodiment thereof.

I claim:

1. In an extrusion press including a container-container holder assembly having a container holder with an opening for supporting a container into which a heated billet is placed, a die slide for supporting a die assembly on the working centerline of the press, and a sealing member and an extrusion stem arranged to move coincident to the working centerline of the press, said extrusion stem positionable on an opposite side of the sealing member relative to the container when positioned in said working position, and said sealing member having an opening through which said extrusion stem extends during an extrusion stroke of the press, said container-container holder assembly being positionable into and out of a working position relative to said working centerline of the press and when in said working position adapted to be positioned between and adjacent to said die slide and said sealing member so that an axis of said container is coaxial with the die assembly, said sealing member, and said extrusion stem during the sealing stroke of the press, said container and said die assembly having cooperating surfaces which contact each other during said sealing stroke of the press, said container-container holder assembly, said die slide, and said sealing member including mutual cooperating means for allowing movement of said container relative to said holder in a direction toward said working centerline to obtain a predetermined registration of said container with said die assembly and said sealing member and for maintaining said container in said predetermined registration, said mutual cooperating means including:

a first means for allowing said movement of said container relative to said container holder, and a second means formed as a part of said container, said die slide and said sealing member for registering and maintaining said container with said die slide and said sealing member in said predetermined registration, said second means constructed and arranged in a manner to be operatively effective during said sealing stroke of said press prior to said contacting of said surfaces of said container and said die assembly.

2. In an extrusion press according to claim 1 wherein said first and second means includes key and keyway means, and with respect to said key and keyway means of said first means for allowing said container movement further including:

clearances provided in said key and keyway means between said container and said container holder.

3. In an extrusion press according to claim 2 wherein said key and keyway means for said second means further includes keys on said container and keyways in said die slide and said sealing member constructed and arranged to prevent relative movement of said container with respect to said die slide and sealing member and with respect to said working centerline when in said predetermined registration.

4. In an extrusion press according to claim 3 wherein said keys on said container and said keyways in said die slide and said sealing member are arranged and constructed in a manner so that said keys always enter into said keyways upon said sealing member contacting said container and said container contacting said die slide.

5. In an extrusion press according to claim 1 said said first means further includes key and keyway means for said movement of said container, said key and keyway means including at least two diametrically opposed sets of keys and keyways located in said container and said container holder for mounting said container in said container holder.

6. In an extrusion press according to claim 5 wherein said at least two diametrically opposed sets of keys and keyways are located around the periphery of said container and the diameter of said opening, and wherein said first set of keys and keyways are located in a common plane perpendicular to a horizontal plane passing through said working centerline of the press, and said second set of keys and keyways are located in a plane coincident with said horizontal plane.

7. In an extrusion press according to claim 6 wherein said diameter of said opening of said holder is greater than said periphery of said container, and further the widths of said keyways in said container or holder of said first set are greater than the width of said first set of keys in said container or holder, and wherein the keys of said second set extend into said keyways of said second set less than the full depth of said keyways of said second set, said differences in the dimensions of said diameters of said opening and periphery, and said widths and depths of said keys and keyways being related to a predetermined compensational movement of said container due to thermal expansion of said container holder in a direction to cause said container to be displaced away from said working centerline.

8. In an extrusion press according to claim 1 wherein said container-container holder assembly is rotatably mounted so that when said container is in said working position an extension of the centerline of said container holder assembly passes through said working centerline and wherein said rotatable mounting is offset from said working centerline, said first means comprising at least two cooperative sets of key and keyway means; said first set of key and keyway means arranged to constrain rotational movement of said container relative to said holder and at the same time allow transverse movement thereof relative to said holder in a direction towards said rotatable mounting of said container-container holder assembly, and said second set of key and keyway means arranged to also allow said transverse movement of said container.

9. In an extrusion press according to claim 8 wherein said container-container holder assembly when subjected to thermal expansion causes a displacement of said container outwardly of said working centerline and wherein said transverse movement occurs in a direction toward said rotatable mounting to permit the container to move back into alignment with said working centerline of the press.

10. In an extrusion press according to claim 1 including a main crosshead carrying said extrusion stem and a mandrel on the working centerline of the press including guideway means extending parallel to the working centerline for providing a common support for said main crosshead and said sealing member on movement thereof toward said container.

* * * * *